United States Patent [19]

Matsuda et al.

[11] Patent Number: 5,009,933

[45] Date of Patent: Apr. 23, 1991

[54] METHOD AND APPARATUS FOR COATING THIN LIQUID FILM ON PLATE SURFACE

[75] Inventors: Naohiko Matsuda, Matsusaka; Kensuke Makita, Mie, both of Japan

[73] Assignee: Central Glass Company, Limited, Ube, Japan

[21] Appl. No.: 397,672

[22] Filed: Aug. 23, 1989

[30] Foreign Application Priority Data

Aug. 26, 1988 [JP] Japan ..... 63-211677
Aug. 29, 1988 [JP] Japan ..... 63-214068

[51] Int. Cl.[5] ..... B05D 5/00; B05D 1/26; B05C 3/18

[52] U.S. Cl. ..... 427/287; 427/256; 427/443.2; 118/407; 118/421; 118/429

[58] Field of Search ..... 427/287, 430.1, 256, 427/443.2; 118/407, 415, 421, 429

[56] References Cited

U.S. PATENT DOCUMENTS

| | | | |
|---|---|---|---|
| 2,127,413 | 8/1938 | Leguillon | 204/180.4 |
| 2,203,910 | 6/1940 | Issartel et al. | 118/415 X |
| 3,052,565 | 9/1962 | Chinn et al. | 118/407 X |
| 3,084,662 | 4/1963 | Badger | 118/50 |
| 3,190,260 | 6/1965 | Merker | 118/407 X |
| 3,690,965 | 9/1972 | Bergh et al. | 437/121 |
| 3,692,592 | 9/1972 | Marinelli | 156/622 |
| 3,905,325 | 9/1975 | Labore et al. | 118/401 X |
| 3,980,046 | 9/1976 | Homan | 118/405 |
| 4,018,953 | 4/1977 | Martellock | 118/404 X |
| 4,620,996 | 11/1986 | Yashiki | 427/430.1 |
| 4,821,675 | 4/1989 | Ikeno et al. | 118/667 |

FOREIGN PATENT DOCUMENTS

| | | |
|---|---|---|
| 709572 | 5/1954 | United Kingdom . |
| 1208122 | 10/1970 | United Kingdom . |
| 1248887 | 10/1971 | United Kingdom . |

*Primary Examiner*—Evan Lawrence
*Attorney, Agent, or Firm*—Fleit, Jacobson, Cohn, Price, Holman & Stern

[57] ABSTRACT

A method and apparatus for coating a plate with a thin liquid film. In the method, a thin liquid film is coated on a surface of a substrate such as a glass plate by using an incomplete liquid tank having an opening of a shape similar to the shape of the substrate surface on one side thereof. The tank communicates with a flow streamlining channel by an aperture in a lower section of the tank. First the substrate and the incomplete tank are brought into tight contact with each other such that the side opening of the tank is closed by the substrate, whereby the tank is completed. Next, a coating liquid such as a metal alkoxide solution is fed into the tank to thereby wet the substrate surface. Preferably the coating liquid is allowed to overflow the tank to remove a surface layer of the liquid. Then the liquid is extracted from the tank through the streamlining channel so as to lower the liquid level in the tank at a predetermined rate while keeping both the tank and the substrate stationary. By this method a submicron coating film of uniform thickness can easily be formed even on a large-sized substrate, and it is easy to form a coating film on only a selected area of the substrate surface without using any masking.

16 Claims, 3 Drawing Sheets

METHOD AND APPARATUS FOR COATING THIN LIQUID FILM ON PLATE SURFACE

BACKGROUND OF THE INVENTION

This invention relates to a method of coating a thin liquid film on a substrate surface and apparatus for the coating method. For example, the coating method is suitable for use in forming a thin film of a metal oxide on a limited area of a surface of a relatively large substrate by a sol-gel method using a soltuion of a metal alkoxide.

Conventional wet coating methods include dip coating method in which the substrate is dipped into a coating liquid and then pulled out at a constant speed, flow coating method in which a coating liquid is flowed from an upper edge of the substrate so as to spread on the substrate surface and roller coating method in which the substrate is carried by a pair of rolls at least one of which is always wetted with the coating liquid.

However, in many cases and particularly in the cases of coating relatively large substrates difficulty or inconvenience is experienced in accomplishing desired coating by any of conventional wet coating methods. As to flow coating method and roller coating method, coating of only a selected area of a substrate surface has to be accomplished by first coating the entire area of the substrate surface and then removing the coating film in the unwanted areas by a troublesome technique such as etching, because it is impracticable to apply masking tape or the like to the unwanted areas. Besides, by either of these coating methods it is very difficult to form a coating film having a submicron and well controlled thickness.

For forming a submicron coating film by a wet coating method, dip coating method is generally accepted as most suitable. However, coating of a large-sized substrate by this method entails large-scale machinary for dipping the substrate into the coating liquid and then pulling out it. Moreover, transverse stripes are liable to appear in the coating film because in pulling out the substrate it is inevitable that vibration of the substrate causes oscillation of the liquid level. By this method it is very difficult to form a broad and uniformly thin coating film. Besides, coating of only a limited area of a substrate surface by dip coating method is troublesome and time-consuming because it is necessary to mask not only the unwanted areas of the substrate surface but also the entire area of the opposite surface or, alternatively, to first coat the entire areas of the both surfaces and then remove the coating film in the unwanted areas of the front surface and over the entire area of the opposite surface.

SUMMARY OF THE INVENTION

It is an object of the present invention to provide a novel method of coating a thin liquid film on a surface of a solid member, by which method a uniformly good coating film having a desired thickness can be formed easily and efficiently even when the solid surface has a wide area and is to be coated only in a limited area.

It is another object of the invention to provide apparatus for the coating method according to the invention.

The present invention provides a method of coating a thin liquid film on a surface of a substrate, the method using an incomplete liquid tank which has an opening of a shape similar to the shape of the surface of the substrate on one side thereof and comprising the steps of (a) bringing the substrate and the incomplete tank into tight contact with each other such that the opening of the incomplete container is closed by the substrate surface thereby completing the tank, (b) introducing a coating liquid into the tank until the liquid level in the tank reaches a predetermined level and (c) while keeping both the tank and the substrate stationay extracting the coating liquid from the tank through a flow streamlining channel so as to lower the liquid level in the tank at a predetermined rate, the streamlining channel communicating with a lower section of the tank by an aperture in a wall of the tank and extending downward from the level of said aperture.

In Japanese Pat. application No. 62-195239 filed Aug. 6, 1987 and the corresponding U.S. patent application Ser. No. 227,673 filed Aug. 3, 1988, we have already proposed a coating method comprising the above stated steps (a), (b) and (c) except the use of the flow streamlining channel in the step (c). The present invention is an improvement on the coating method (and apparatus) disclosed in the above Japanese and U.S. applications primarily in respect of the manner of extracting the coating liquid from the tank.

In the coating method according to the invention, the step (b) corresponds to the dipping step in a conventional dip coating method. That is, at the end of the step (b) the intended coating area of the substrate is wetted with the coating liquid. At the step (c), the coating liquid is extracted from the tank at a constant rate without moving either of the tank and the substrate. In effect this step corresponds to the pull-out step in a conventional dip coating method.

By the method according to the invention coating of a liquid film on a surface of the substrate is accomplished without relative movement of the substrate and the tank containing the coating liquid, and the film thickness is determined by the viscosity of the coating liquid and the rate of lowering of the liquid level in the tank. Therefore it is easy to control the coating film thickness, and it is practicable to form a submicron coating film with good uniformity of thickness even when the substrate is large in size. Furthermore, by this method it is easy to form a coating film on only a selected area of a substrate surface since the size of the coating film is determined by the size of the side opening of the incomplete tank. There is no need of masking the unwanted areas of the substrate surface or removing a large portion of the coating film.

According to the aforementioned prior applications the coating liquid is extracted from the tank by a small hole in the bottom of the tank. Subsequently we have found that during the liquid extracting operation the coating liquid is liable to make a swirling turburence in each corner region of a bottom section of the tank and that such turburence of the coating liquid within the tank is liable to cause unevenness of the thickness of the liquid film formed on the substrate surface. The present invention has solved this problem by extracting the coating liquid from the tank through a flow streamlining channel to thereby maintaining a streamline flow of the coating liquid in the tank.

The present invention includes an improvement in another respect, though the employment of this improvement is optional. That is, at the above stated step (b) it is preferable to allow the coating liquid to overflow the tank by introducing the coating liquid into the tank such that the liquid level in the tank slightly exceeds the predetermined level. The purpose of overflowing the coating liquid is removing foreign matter such as dust floating on the liquid surface prior to the step (c) and also removing a surface layer of the coating liquid in view of a possibility that the concentration of the coating liquid increases in the surface layer by natural evaporation of an organic solvent used in the coating liquid.

Another aspect of the present invention is an apparatus for coating a liquid film on a surface of a substrate. An apparatus according to the invention comprises means for holding the substrate, an incomplete liquid tank having an opening of a shape similar to the shape of the surface of the substrate on one side thereof, means for defining a flow streamlining channel which communicates with the tank by an aperture formed in a lower section of the tank and extends downward from the level of said aperture, means for bringing the substrate and the incomplete tank into tight contact with each other such that the side opening of the incomplete tank is closed by the substrate surface thereby completing the tank and keeping the tank and the substrate stationary in the tightly contacting state, means for introducing a coating liquid into the tank, and means for extracting the coating liquid from the tank at a predetermined rate through the streamlining channel.

Except the provision of the means for defining the flow streamlining channel, the above stated apparatus is disclosed in the aforementioned prior applications.

In an apparatus according to the invention, preferably small apertures are formed in an uppermost region of a complete side wall of the incomplete tank so as to allow the coating liquid to overflow the completed tank by said small apertures. For example, the small apertures are formed by serrating the upper edge of the tank wall opposite to the side formed with the opening to be closed by the substrate.

In a preferred embodiment of the coating apparatus, the coating liquid extracting means comprises a coating liquid reservoir connected by a tube to the terminal end of the flow streamlining channel and means for moving the reservoir to change its vertical position. In another preferred embodiment, the coating liquid extracting means comprises a pipe which extends downward from the terminal end of the flow streamlining channel and is provided with a valve of which the degree of opening is controllable.

The present invention has wide applications and is very favorable for the manufacture of, for example, various reflectors, ornamental plates and combiners of head-up displays.

DESCRIPTION OF THE PREFERRED EMBODIMENTS

Figure 1:
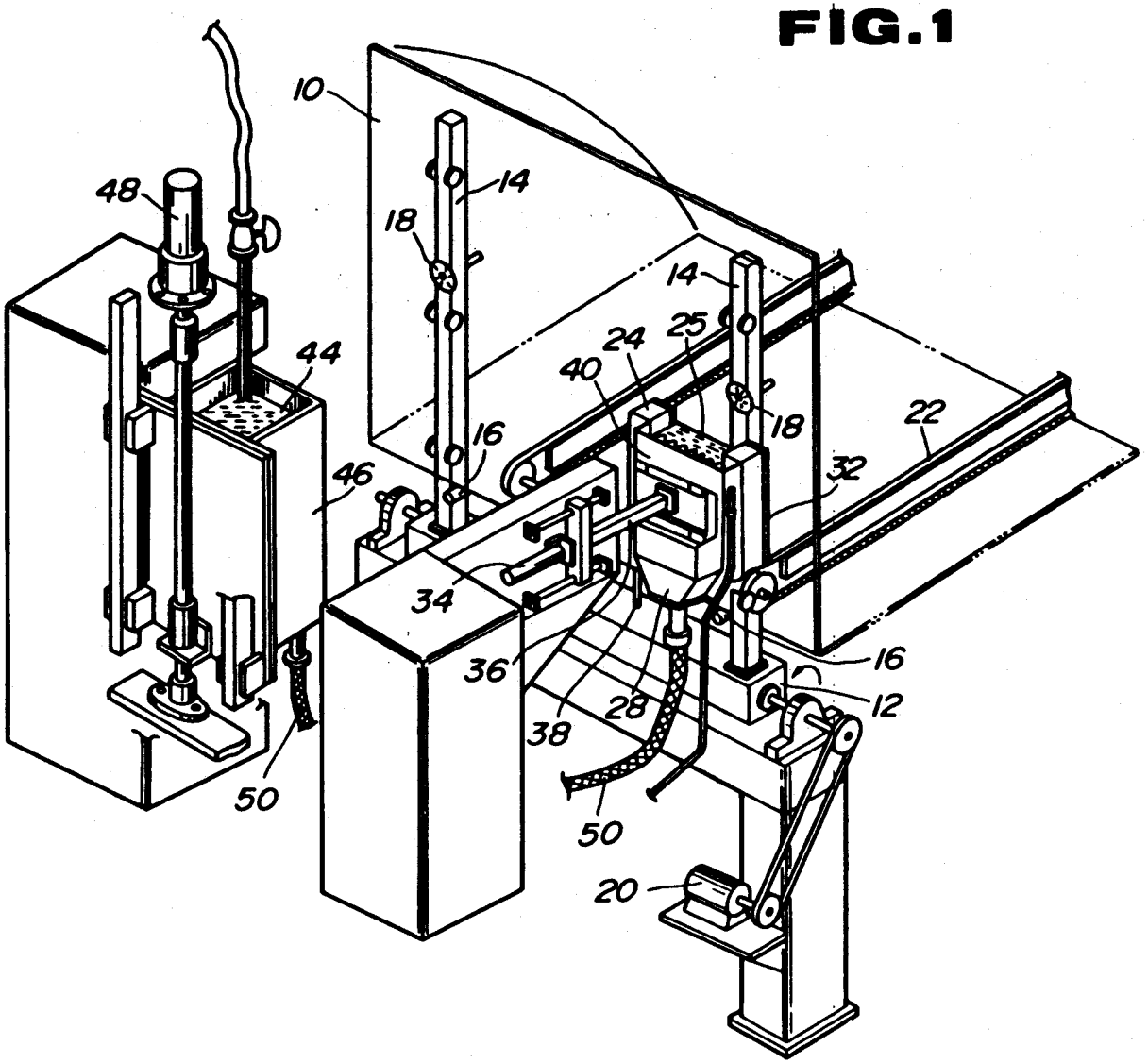
FIG. 1 is a perspective view of a coating apparatus embodying the present invention.

FIG. 1 shows an example of coating apparatus according to the invention. This apparatus is for coating a liquid film on a selected area of a flat substrate 10 such as a glass sheet.

The coating apparatus has a shaft 12 which is arranged horizontally and can be turned about its longitudinal axis by a driving means 20. To hold the substrate 10 vertically a pair of arms 14 extend from the shaft 12 perpendicularly, and each arm 14 has a stopper 16 and a suction pad 18. A belt conveyor 22 is arranged to convey the substrate 10 to the site of the coating apparatus while the arms 14 are held horizontally. The conveyed substrate 10 rests on the arms 14, and then the shaft 12 is turned to stand up the arms 14 supporting the substrate 10.

Figure 2:
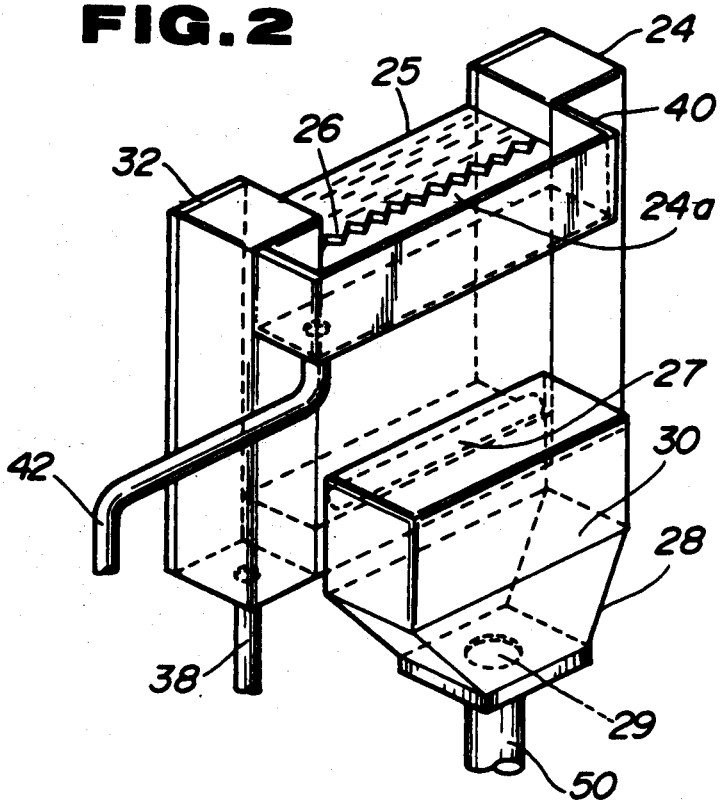
FIG. 2 is a perspective view of a coating liquid tank used in the coating apparatus of FIG. 1.

The principal component of the appatus is a coating tank 24 which is held by a suitable support (omitted from illustration to avoid complicacy) so as to stay adjacent a selected area of the substrate 10. As shown in FIG. 2 the tank 24 is a lidless box-like incomplete container having an opening 25 on one of the four sides. The tank 24 is held such that the opening 25 faces the substrate 10. The opening 25 is similar in shape to the intended coating area of the substrate surface and usually slightly broader than the intended coating area. By operating an air cylinder 34 having a rod 36 fixed to the tank 24, the tank 24 can be moved toward the substrate 10 or backward. When the tank 24 is brought into contact with the substrate 10 the opening 25 is completely closed by the substrate 10, whereby a container is completed. The tank has a double wall structure at the bottom and the righthand and lefthand sides adjacent the side formed with the opening 25, and a pipe 38 connects the hollow sections provided by the double wall structure to a vacuum pump (not shown). The tank 24 is provided with elastomeric coverings 32 on the outer surfaces facing the substrate 10.

As a flow streamlining device, a box-like framework 28 is attached to the tank 24 on the wall **24*a* opposite to the opening 25. At an upper section the interior of the framework 28 communicates with the interior of the tank 24 by an opening 27 in a lower region of the wall 24*a*. In a lower section the box-like framework is tapered so as to reduce its horizontal sectional area as the vertical distance from the opening 27 increases. There is a hole 29 in the bottom of the box-like framework 28. The interior of the framework 28 is used as a streamlining channel 30 through which a coating liquid 44 is introduced into the tank 24** and discharged therefrom.

As an optional and preferable feature, the upper edge of the tank wall **24*a* is serrated to provide a series of small apertures 26 partitioned from each other by sawteeth. When the level of the coating liquid 44 in the tank 24 is slowly and unlimitedly raised the liquid overflows the tank 24 by these apertures 26 while the sawtooth regions of the wall 24*a* serve as weirs. To receive the liquid overflowed the tank 24, a tray 40 is formed on the wall 24*a*. Numeral 42 indicates a pipe for recovery of the coating liquid from the tray 40**.

The coating apparatus includes a coating liquid reservoir 46 having a small hole (not shown) in the bottom. Using this hole and the hole 29 in the box-like framework 28, a tube 50 provides communication between the reservoir 46 and the tank 24. The coating liquid reservoir 46 is vertically movably supported by a lifting mechanism 48.

The coating apparatus of FIG. 1 is operated in the following way to coat the coating liquid 44 on a predetermined area of the substrate 10.

Initially the coating liquid reservoir 46 is held at a sufficiently low position such that the the level of the coating liquid 44 in the reservoir 46 is below the bottom of the coating tank 24 (in the incomplete state). In that state, the substrate 10 is brought to the position shown in FIG. 1 by operating the belt conveyor 22 and the driving means 20. While the arms 14 are turning from the horizontal state to the vertical state the suction pads 18 are actuated to securely holding the substrate 10 resting on the stoppers 16. Then the air cylinder 34 is operated to bring the incomplete tank 24 into contact with the substrate 10, and the vacuum pump to which the pipe 38 is connected is operated to suck air from the hollow sections of the tank 24 to thereby enhance tightness of contact of the substrate 10 with the incomplete tank 24. By this operation the opening 25 of the tank 24 is closed whereby the tank 24 is completed. Next, the lifting mechanism 48 is operated to lift the coating liquid reservoir 46 until the liquid level in the reservoir 46 becomes slightly higher than the upper edge of the intended coating area of the substrate 10. By this operation the coating liquid 44 enters the tank 24, and the liquid level in the tank 24 rises until it slightly exceeds a predetermined level to result in that a small portion of the coating liquid 44 overflows the tank 24 by the small apertures 26. When the liquid level in the tank 24 stabilizes at the predetermined level, the lifting mechanism 48 is reversely operated to lower the reservoir 46 at a constant speed until the liquid level in the reservoir 46 becomes lower than the bottom of the tank 24. This operation causes the liquid level in the tank 24 to lower at a constant rate until the coating liquid 44 is almost completely extracted from the tank 24. After that the evacuated hollow sections of the tank 24 are allowed to resume normal pressure, and then the air cylinder 34 is reversely operated to detach the tank 24 from the substrate 10. Next, the driving means 20 is operated to turn the arms 14 to the horizontal state, and then the suction pads 18 are relieved of suction to allow the substrate 10 to lie on the belt conveyor 22. The coating liquid 44 overflowed the coating tank 24 is recovered from the tray 40 via a physically refining means.

After the above operations the substrate 10 is subjected to drying and heat treatment to convert the liquid film coated thereon into a solid coating film.

For example, a titanium alkoxide solution using isopropyl alcohol as the principal component of the solvent was coated by the above described method on a glass plate. In the coating operation the speed of lowering the coating liquid reservoir 46 from the lifted position was such that the liquid level in the coating tank 24 lowered at a rate of about 2 mm/sec. After the coating operation the liquid film on the glass plate was left to drying at room temperature, and then the glass plate was heated in an electric furnace at 550° C. for 5 min. As the result, a $TiO_2$ film uniformly having a thickness of 0.1 μm was formed on a selected area of the glass plate.

Figure 3:
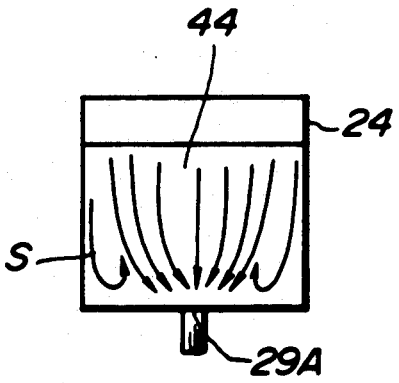
FIG. 3 is an explanatory illustration of a turburent flow of a coating liquid in a coating liquid tank used in a precedingly proposed coating apparatus.

In the coating apparatus of FIG. 1, the flow streamlining device 28 provided to the coating tank 24 serves the purpose of extracting the coating liquid 44 from the tank 24 without producing a turburent flow in the tank 24. Referring to FIG. 3, when the tank 24 has a hole 29A at the bottom to communicate with the coating liquid reservoir 46 and is not provided with the streamlining device 28, it is likely that during extracting the coating liquid 44 from the tank 24 a swirling turburence of the coating liquid occurs in each corner region of a bottom section of the tank 24 as indicated by arrows S. Such turburence of the liquid in the tank 24 makes it difficult to lower the liquid level in the tank 24 at a constant rate and, hence, becomes a cause of unevenness of the thickness of the liquid film coated on the substrate 10.

Figure 4:
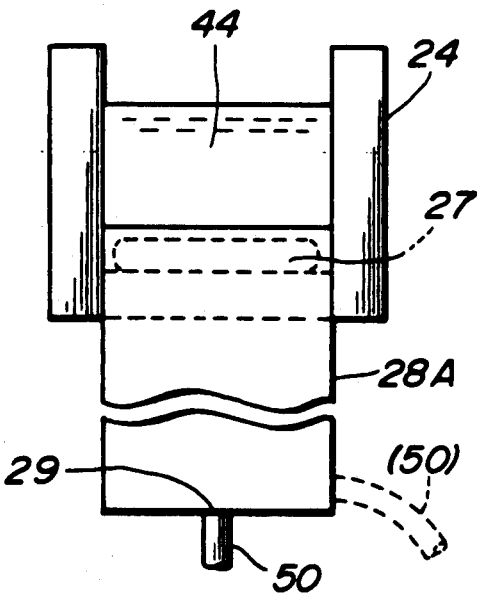
FIG. 4 is an elevational view of a coating liquid tank as an alternative to the tank of FIG. 2.

In the apparatus shown in FIGS. 1 and 2 the downward flow of the coating liquid 44 in the tank 24 does not become turburent because the liquid 44 smoothly flows into the streamlining device 28 by a relatively large opening 27 and makes a streamline flow in the device 28. When a lower part of the streamlining device 28 is downwardly tapered to gradually reduce its horizontal sectional area as in this embodiment, the tapering begins at a section lower than the bottom of the tank 24. In this embodiment the tapered part of the device 28 is in the shape of a truncated rectangular pyramid, but this is not limitative. For example, the shape of a truncated triangular pyramid is an alternative. Moreover, the streamlining device 28 is not necessarily tapered. FIG. 4 shows another streamlining device 28A, which is a rectangular box-like framework sufficiently long in the vertical direction and constant in horizontal sectional area. The increased vertical length of this device 28A produces an effect similar to that of the tapering of the device 28 in FIG. 2. In the device 28A of FIG. 4, the hole 29 for connecting the tube 50 may be formed in a side wall as indicated by the tube (50) in broken line.

In the illustrated embodiements the streamlining device 28 (28A) is attached to the back side wall 24*a* of the tank 24, but it is also possible to attach this device to the bottom of the tank 24.

For the purpose of preventing turburence of the coating liquid it is favorable to make the opening 27 connecting the tank 24 and the streamlining device 28 as large as possible. In the coating operation, the speed of lowering of the liquid level in the tank 24 is determined according to the desired thickness of the liquid film to be formed on the substrate surface. It is suitable to determine the area of the opening 27 such that the flow velocity of the coating liquid at the opening 27 is not more than 6 times, and preferably not more than 4 times, the speed of lowering of the liquid level in the tank 24. In other words, it is suitable that the area of the opening 27 is not smaller than 1/6, and preferably not smaller than ¼, of the horizontal sectional area of the tank 24.

In the coating method described above the coating liquid 44 was forced to overflow the coating tank 24 to remove a surface layer of the coating liquid in the tank 24 before starting lowering the liquid level in the tank 24. Since the tank 24 is open at the top there is a possibility that dust floats on the coating liquid 44 introduced into the tank 24, and, besides, there is a possibility that the concentration of the coating liquid 44 becomes higher in a surface layer in the tank 24 because of evaporation of the solvent from the surface. Of course it is undesirable to coat a dust containing liquid on the substrate 10. A local change in the concentration of the coating liquid 44 will lead to unevenness of the thickness of the liquid film coated on the substrate 10. These problems will be solved by lidding the tank 24. However, if the tank 24 is lidded it becomes difficut to slowly extract the coating liquid 44 from the tank 24 in the above described coating method, and, even though the coating operation is made by overcoming the difficulty, there arises a possibility of unevenness of the thickness of the liquid film by reason of slowness of natural drying of the liquid film surface immediately after applying the liquid 44 shielded from the atmosphere to the substrate surface. Therefore, the present invention proposes to force the coating liquid to overflow the tank 24.

Figure 5:
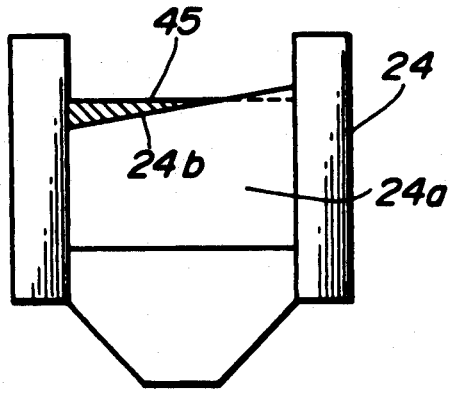
FIG. 5 is an explanatory illustration of the overflow of a liquid from a tank fundamentally similar to the tank of FIG. 2.
Figure 6:
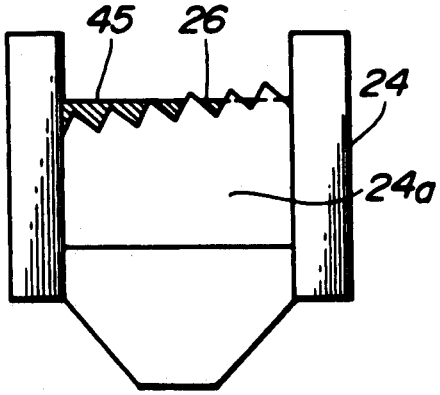
FIG. 6 is an explanatory illustration of the overflow of a liquid from the tank of FIG. 2.

In the above described coating apparatus the upper edge of the tank wall 24a is serrated so that the coating liquid 44 overflows by the small apertures 26 formed in the pattern of sawteeth. This is preferable but is not indispensable. The liquid 44 can overflow the tank 24 even when an uppermost portion of the tank wall 24a is cut away such that the wall 24a has a straight edge as a new upper edge. However, in practice it is difficult to make the new upper edge of the tank wall 24a very accurately parallel to the liquid level in the tank 24, and accordingly the manner of the overflow of the liquid 44 becomes as explanatorily illustrated in FIG. 5, wherein numeral 24b indicates the new upper edge of the tank wall 24a and numeral 45 the liquid surface. The hatched area in FIG. 5 represents the amount of overflow of the liquid 44. For comparison, when the upper edge of the tank wall 24a is serrated the manner of overflow of the coating liquid 44 becomes as explanatorily illustrated in FIG. 6, wherein the hatched area represents the amount of the overflow. Assuming the same amount of overflow of the liquid 44 in the both cases of FIGS. 5 and 6, the overflow takes place over a wider area in the case of FIG. 6, and the overflowing liquid has a higher velocity in the case of FIG. 6 because of smallness of each of the apertures 26. Therefore, the serration of the upper edge of the tank wall 24a is effective for removing floating foreign matter over nearly the entire area of the liquid surface in the tank 24. However, the upper edge of the wall 24a may be a straight edge when it is possible to make the edge accurately parallel to the liquid surface 45 or when the amount of overflow of the coating liquid 44 is relatively large.

Figure 7:
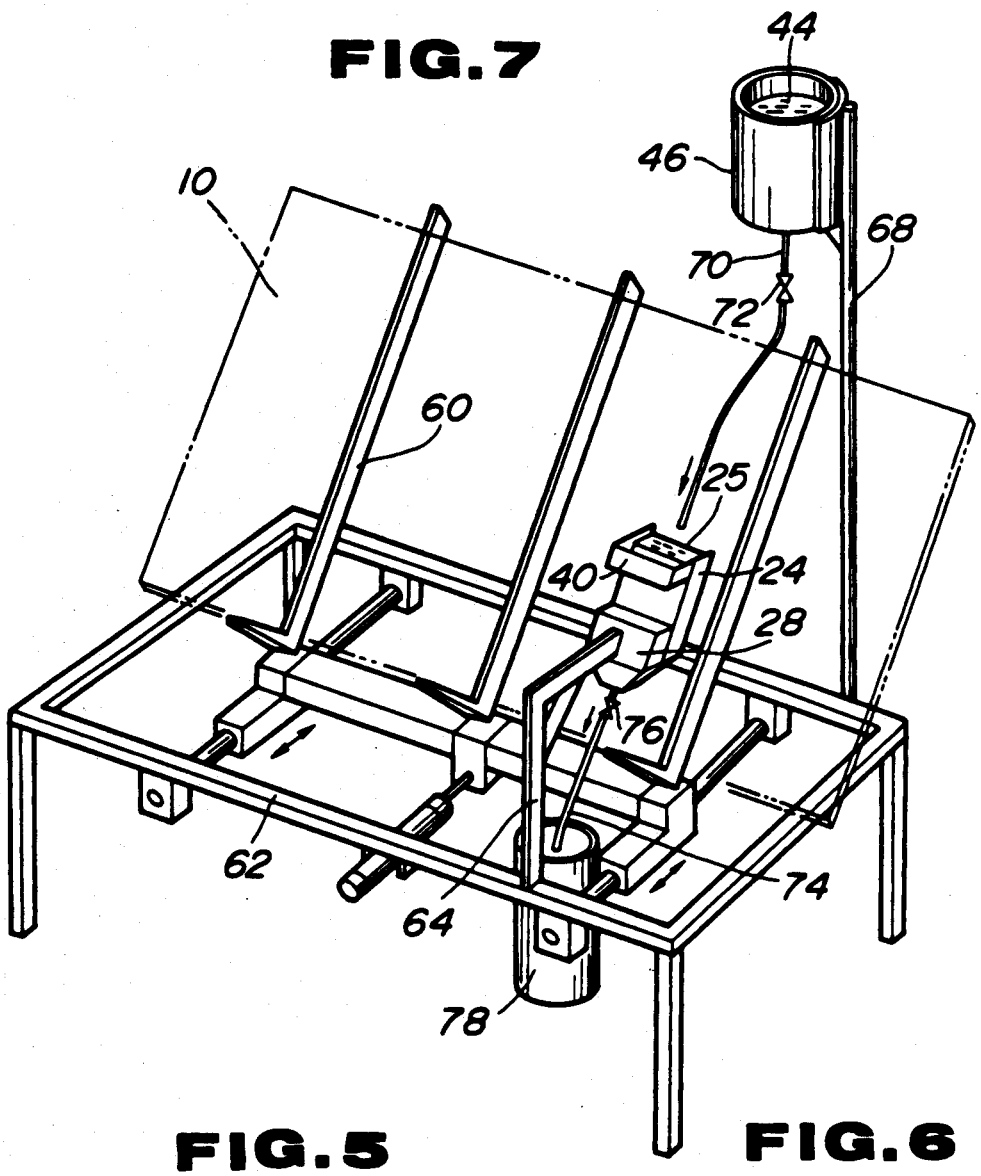
FIG. 7 is a perspective view of another coating apparatus according to the invention.

FIG. 7 shows another example of coating apparatus according to the invention. A substrate 10 such as a glass sheet is held inclined on a stand 60 which is installed on a bed 62 and can be moved reciprocatively as indicated by arrows. The assembly of the coating tank 24 (incomplete container), streamlining device 28 and the liquid receiving tray 40 described with reference to FIGS. 1 and 2 is held inclined and stationary by an angled bar 64 fixed to the bed 62. A pole 68 standing on the bed 62 holds a coating liquid reservoir 46 such that the bottom of the reservoir 46 is higher than the top of the coating tank 24. The reservoir 46 has a small hole (not shown) at the bottom, and a pipe 70 provided with a valve 72 extends downward from the hole to the open top of the tank 24. A pipe 74 provided with a valve 76 extends downward from the holed bottom of the streamlining device 28 to a liquid recovering vessel 78.

Using the apparatus of FIG. 7, a liquid film is coated on a predetermined area of the substrate 10 by the following operations.

First the stand 60 is moved to bring the substrate 10 into tight contact with the coating tank 24 to close the opening 25 of the tank 24. Then the valve 72 is opened to feed the coating liquid 44 into the tank 24 until the liquid level in the tank 24 slightly exceeds a predetermined level so that the coating liquid 44 overflows the tank 24. Then the valve 72 is closed, and when the liquid level in the tank 24 stabilizes at the predetermined level the valve 76 is opened so as to lower the liquid level in the tank 24 at a predetermined and approximately constant rate. The wet coating operation comes to an end when the flow of the coating liquid from the tank 24 into the streamlining device 28 stops. Then the stand 60 holding the substrate 10 is retracted, and the substrate 10 is subjected to usual drying and heat treatment. The apparatus of FIG. 7 is also very suitable for coating a titanium alkoxide solution on a glass substrate.

The present invention is not limited to the above described examples. Besides $TiO_2$ films, representative examples of thin films to be formed by using the present invention are $SiO_2$ films, $ZrO_2$ films, $Al_2O_3$ films and mixed oxide films containing any of the named oxides for optical and other purposes and dichromate gelatin films for hologram, and the coating liquid can be selected from various solutions and dispersions. The material of the substrate is not limited either. Not only glasses but also metals, plastics and ceramics can be coated by the method according to the invention. Even though the substrate surface to be coated is a curved surface it is possible to utilize the present invention by forming the open side of the coating tank in conformity with the shape of the substrate surface.

Although the present invention is very suitable for coating of a limited area of a substrate surface, it is also possible to coat a liquid film over substantially the entire area of one surface of a substrate by using a coating tank large enough to form a side opening having nearly the same area as the substrate surface.

What is claimed is:

1. A method of coating a thin liquid film on a surface of a substrate over a predetermined area of the surface, comprising the steps of:

(a) bringing the substrate and an incomplete tank, which has an opening of a shape similar to the shape of said surface of the substrate on one side thereof, into tight contact with each other such that said opening is closed by said surface of the substrate thereby completing the tank;

(b) introducing a coating liquid into said tank until the liquid level in the tank reaches a predetermined level which corresponds to the upper boundary of said area of the substrate surface; and (c) while keeping both said tank and the substrate stationary, extracting the coating liquid from said tank through a flow streamlining channel so as to lower the liquid level in the tank at a predetermined rate without producing a turbulent flow of the coating liquid to thereby leave a film of the coating liquid on said surface of the substrate, said streamlining channel communicating with a lower section of said tank by an aperture in a wall of said tank and extending downward from the level of said aperture.

2. A method according to claim 1, wherein said aperture has an area not smaller than 1/6 of the horizontal sectional area of said tank.

3. A method according to claim 2, wherein said area of said aperture is not smaller than ¼ of said horizontal sectional area.

4. A method according to claim 1, wherein the step (b) comprises the sub-step of initially forcing the liquid level in said tank to slightly exceed said predetermined level and thereby forcing a portion of the coating liquid to overflow said tank.

5. A method according to claim 1, wherein said opening of said incomplete tank is smaller in area than said surface of the substrate, whereby a liquid film is coated on only a selected area of said surface of the substrate.

6. A method according to claim 1, wherein said coating liquid is a solution of a metal alkoxide in an organic solvent.

7. A method according to claim 1, wherein said substrate is a glass plate.

8. An apparatus for coating a thin liquid film on a surface of a substrate over a predetermined area of the surface, the apparatus comprising:

means for holding the substrate;

an incomplete liquid tank having an opening of a shape similar to the shape of said surface of the substrate on one side thereof;

means for defining a flow streamlining channel which communicates with said tank by an aperture formed in a lower section of said tank and extends downward from the level of said aperture;

means for bringing the substrate and said incomplete tank into tight contact with each other such that said opening of said tank is closed by the substrate thereby completing the tank and keeping the tank and the substrate stationary in the tightly contacting state;

means for introducing a coating liquid into said tank kept stationary and in contact with the substrate; and means for extracting the coating liquid from said tank kept stationary and in contact with the substrate at a predetermined rate through said streamlining channel without producing a turbulent flow of the coating liquid to thereby leave a film of the coating liquid on the substrate surface.

9. An apparatus according to claim 8, wherein said aperture has an area not smaller than 1/6 of the horizontal sectional area of said tank.

10. An apparatus according to claim 9, wherein said area of said aperture is not smaller than ¼ of said horizontal sectional area.

11. An apparatus according to claim 8, wherein said means for defining said streamlining channel comprises a box-like framework which is attached to said tank and is downwardly tapered in a section lower than the bottom of said tank.

12. An apparatus according to claim 8, wherein said tank is open at the top, an uppermost portion of a wall of said tank being cut away so as to allow the coating liquid introduced into said tank to overflow.

13. An apparatus according to claim 12, wherein the upper edge of said wall is serrated.

14. An apparatus according to claim 8, wherein said means for introducing the coating liquid into said tank and said means for extracting the coating liquid from said tank are unitary and comprise a coating liquid reservoir, a tube which provides communication between said reservoir and the lower end of said streamlining channel and means for moving said reservoir so as to change the vertical position of said reservoir.

15. An apparatus according to claim 8, wherein said means for extracting the coating liquid from said tank comprises a pipe which extends from the lower end of said streamlining channel and a valve which is provided to said pipe and of which the degree of opening is controllable.

16. An apparatus according to claim 8, wherein said opening of said incomplete tank is smaller in area than said surface of the substrate.

* * * * *